US008051999B2

(12) United States Patent
Carmody et al.

(10) Patent No.: US 8,051,999 B2
(45) Date of Patent: Nov. 8, 2011

(54) THREADABLE CLOSURE WITH SPLIT SECURING WALLS AND LOCKING NOTCHES

(75) Inventors: Suzanne M. Carmody, Cranston, RI (US); Aidan Petrie, Jamestown, RI (US); Daniel Nelsen, Providence, RI (US); Margaux Boyaval, Pascoag, RI (US); Gerhard Andrew Foelsche, Rehoboth, MA (US); Chad E. Rice, Lancaster, PA (US); Joseph J. Bruchman, Lancaster, PA (US); W. Gordon Beecroft, Leola, PA (US); Brian Dombrowski, Lititz, PA (US); John Anthony Vassallo, Lititz, PA (US)

(73) Assignee: CVS Pharmacy, Inc. a Rhode Island corporation, Woonsocket, RI (US)

( * ) Notice: Subject to any disclaimer, the term of this patent is extended or adjusted under 35 U.S.C. 154(b) by 415 days.

(21) Appl. No.: 12/398,456

(22) Filed: Mar. 5, 2009

(65) Prior Publication Data

US 2009/0223985 A1 Sep. 10, 2009

Related U.S. Application Data

(60) Provisional application No. 61/033,879, filed on Mar. 5, 2008.

(51) Int. Cl.
*B65D 45/30* (2006.01)
*B65D 41/04* (2006.01)
*B65D 41/06* (2006.01)

(52) U.S. Cl. ..... 215/330; 215/216; 215/219

(58) Field of Classification Search ..... 215/216, 215/219, 330
See application file for complete search history.

(56) References Cited

U.S. PATENT DOCUMENTS 3,770,153 A 11/1973 Gach et al.
3,771,685 A 11/1973 Micallef
4,116,351 A * 9/1978 Uhlig ..... 215/216
(Continued)

FOREIGN PATENT DOCUMENTS

GB 2159801 A 12/1985

OTHER PUBLICATIONS

O-I Global, http://www.o-i.com/index.aspx?id=821, Publication Date: Feb. 16, 2007.

*Primary Examiner* — J. Gregory Pickett
*Assistant Examiner* — Ned A Walker
(74) *Attorney, Agent, or Firm* — Barlow, Josephs & Holmes, Ltd.

(57) ABSTRACT

A closure construction of the present invention includes a container with male threading on the neck thereof with a pair of locking notches. The cap includes a pair of split arcuate walls with partial threading thereon, which provides, in cooperation with each other, a threaded connection between the cap and the male threading disposed thereby releasably securing the cap to the container. A pair of protrusions are connected to and emanate inwardly from the inner surface of the outer wall. The pair of protrusions are releasably respectively seated in the pair of locking notches when the cap is threaded past a predetermined point onto the neck of the container. When the cap is squeezed in a direction generally perpendicular to a line running through the protrusions, the protrusions lift out of their respective locking notches to permit the cap to be unthreaded from the container.

7 Claims, 6 Drawing Sheets

U.S. PATENT DOCUMENTS

| | | | | | |
|---|---|---|---|---|---|
| 4,117,945 | A | | 10/1978 | Mumford | |
| 4,138,028 | A | | 2/1979 | Price et al. | |
| 4,335,823 | A | | 6/1982 | Montgomery et al. | |
| 4,364,483 | A | | 12/1982 | Golde | |
| 4,948,002 | A | * | 8/1990 | Thornock et al. | 215/221 |
| 4,967,921 | A | * | 11/1990 | Pre et al. | 215/295 |
| 5,038,454 | A | * | 8/1991 | Thornock et al. | 29/451 |
| D330,677 | S | * | 11/1992 | Thornock et al. | D9/558 |
| 5,671,853 | A | * | 9/1997 | Herr | 215/216 |
| 5,687,863 | A | | 11/1997 | Kusz | |
| 5,836,466 | A | * | 11/1998 | Briere et al. | 215/216 |
| 5,865,330 | A | * | 2/1999 | Buono | 215/216 |
| 5,884,787 | A | | 3/1999 | Quintard et al. | |
| 5,915,576 | A | | 6/1999 | Robinson | |
| 5,927,526 | A | * | 7/1999 | Herr | 215/216 |
| 5,988,412 | A | * | 11/1999 | Minnette et al. | 215/216 |
| 6,003,700 | A | * | 12/1999 | Julian et al. | 215/216 |
| 6,036,036 | A | | 3/2000 | Bilani et al. | |
| 6,112,921 | A | * | 9/2000 | Robinson | 215/216 |
| 6,296,130 | B1 | * | 10/2001 | Forsyth et al. | 215/219 |
| 6,357,615 | B1 | | 3/2002 | Herr | |
| 6,609,637 | B1 | * | 8/2003 | Suffa | 222/545 |
| 6,640,987 | B2 | | 11/2003 | Vassallo | |
| 6,854,613 | B2 | * | 2/2005 | Biesecker et al. | 215/219 |
| 7,334,694 | B2 | * | 2/2008 | Suffa | 215/216 |
| D597,410 | S | * | 8/2009 | Carmody et al. | D9/529 |
| 7,641,064 | B2 | * | 1/2010 | Robinson | 215/216 |
| 7,815,062 | B2 | * | 10/2010 | Suffa | 215/221 |
| 2002/0162817 | A1 | * | 11/2002 | Vassallo | 215/216 |
| 2006/0108312 | A1 | * | 5/2006 | Robinson | 215/216 |
| 2006/0213860 | A1 | | 9/2006 | Robinson | |

* cited by examiner

THREADABLE CLOSURE WITH SPLIT SECURING WALLS AND LOCKING NOTCHES

CROSS REFERENCE TO RELATED APPLICATION

This application is related to and claims priority from earlier filed provisional patent application Ser. No. 61/033,879, filed Mar. 5, 2008, the entire contents thereof is incorporated herein by reference.

BACKGROUND OF THE INVENTION

The invention relates generally to closures and more specifically, to closures for bottles and other vessels.

It is well known in the art to provide a closure for a vessel, such as a bottle container. For example, a bottle includes an open top end, such as in the form of an open mouth. Objects, such as pills, are typically loaded into the bottle container via the open mouth end for storage therein.

There is a desire to provide a closure for the container to protect the contents therein from water, heat and other elements and to maintain the contents in a single organized location. There is also a desire to use a closure to prevent unwanted access to the contents of the container by certain individuals. For example, there is a need to provide a pill container that includes a child-resistant cap to enclose the contents and to keep children from gaining access to those contents.

Closures for such containers are available in many different types and configurations. For example, a cap can be provided that simply snaps onto the mouth of the container to close it off. However, these caps are frequently difficult to use, particularly by elderly users, and are not child-resistant in nature. There have been many attempts in the prior art to provide a cap that is easy to open by adults but is difficult to open by children.

Prior art closures address the foregoing problems by providing some type of locking arrangement between the cap closure and the body of the bottle container. In many prior art locking closures, the cap is attached to a portion of the bottle by threading, such as to the neck where the cap is rotated relative to the bottle so that the aforesaid locking arrangement can engage for locking and disengage for unlocking. It should be understood that the term "threading" may be construed to be any type of securing structure that locks the cap to the bottle. Such a structure may be threading the form of helical threads or protrusions that engage with seats to form the desired locking.

To carry out these prior art constructions, the cap commonly includes female threading to threadably receive the male threading about the mouth of the bottle container. The female threading is typically provided 360 degrees about the inside of a wall or on a downwardly depending skirt to engage with the male threads on the bottle closure. For the 360 degree threaded member on the cap to receive the male threaded bottle mouth requires that the overall dimensions of the cap be large enough to carry the 360 degree female threading. In that connection, since there is also a need for a fairly large mouth opening, such as 1.0 inch or 1.25 inches, for example, to accommodate automated filling machine, the overall dimension of the cap must be very large, such as about 50 mm in diameter. Therefore, employing known locking constructions, the size of the cap must be fairly large thereby making the overall container quite large. However, large cap closures are more bulky to carry and are also aesthetically unattractive.

Therefore, there is a need to provide a locking arrangement for a bottle and cap closure device that enables the cap to be smaller than prior art devices yet be able to secure the same size opening in the bottle container.

There is also a need for a bottle and cap closure device that includes a structure for securing the cap to the bottle.

There is a further need to provide a bottle and cap closure device that is relatively easy to open by an adult but includes child-resistance to deter access to the contents of the bottle by children.

SUMMARY OF THE INVENTION

The present invention preserves the advantages of prior art bottle containers and cap closures and devices therefor. In addition, it provides new advantages not found in currently available bottles and cap closures and devices overcomes many disadvantages of such currently available caps and containers.

The closure device construction of the present invention includes a container with male threading on the neck thereof with a pair of locking notches. The cap includes a pair of split arcuate walls with partial threading thereon, which provides, in cooperation with each other, a threaded connection between the cap and the male threading disposed thereby releasably securing the cap to the container.

A pair of protrusions, such as ribs, are connected to and emanate inwardly from the inner surface of the outer wall. The pair of protrusions are releasably respectively seated in the pair of locking notches when the cap is threaded past a predetermined point onto the neck of the container. The protrusions and the notches are preferably complementarily ramped in configuration so that the protrusions cam into the notches when the cap is being threaded onto the container. A stop is preferably provided that prevents the cap from threading past a predetermined position. Once the protrusions reside in their respective notches on the container, the cap cannot be unthreaded to separate it from the container unless first unlocked.

When the cap is squeezed in a direction generally perpendicular to a line running through the protrusions, the protrusions lift out of their respective locking notches and clear therefrom to permit the cap to be unthreaded from the container.

It is therefore an object of the present invention to provide a device with a container that has a cap that can releasably lock to a container to control access to the contents therein.

Another object of the invention is to provide a device with a locking arrangement for a bottle and cap closure that enables the cap to be smaller than prior art devices yet be able to secure the same size opening in the bottle container.

Another object of the invention is to provide a bottle and cap closure device that includes a structure for securing the cap to the bottle.

A further object of the invention is to provide a lockable bottle and cap device construction that is more aesthetically pleasing than prior art bottles and caps.

Yet another object of the present invention is to provide a bottle and cap closure device that is relatively easy to open by an adult but includes child-resistance to deter access to the contents of the bottle by children.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
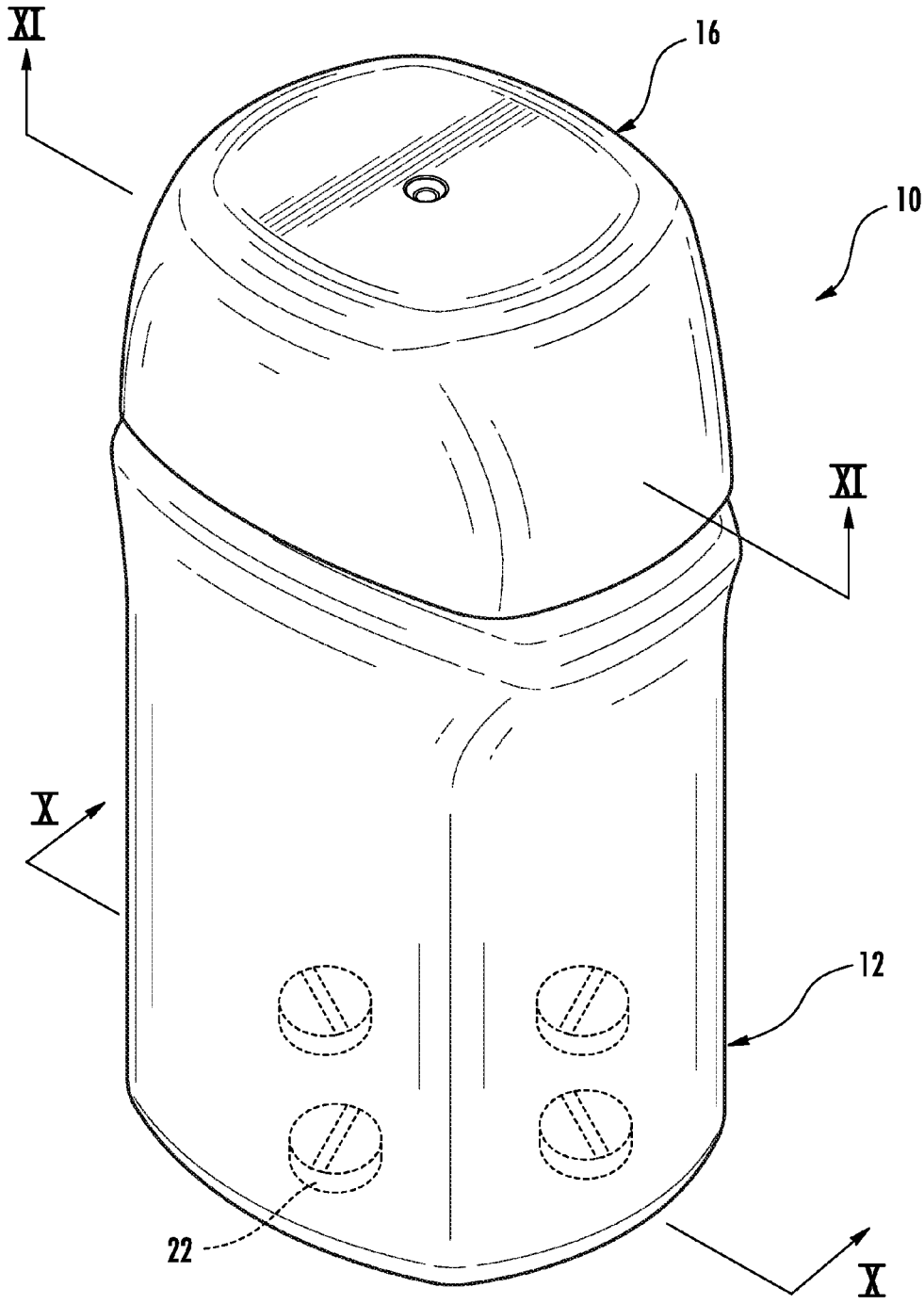
FIG. 1 is a perspective view of the cap and container of the present invention shown in assembled form.
Figure 2:
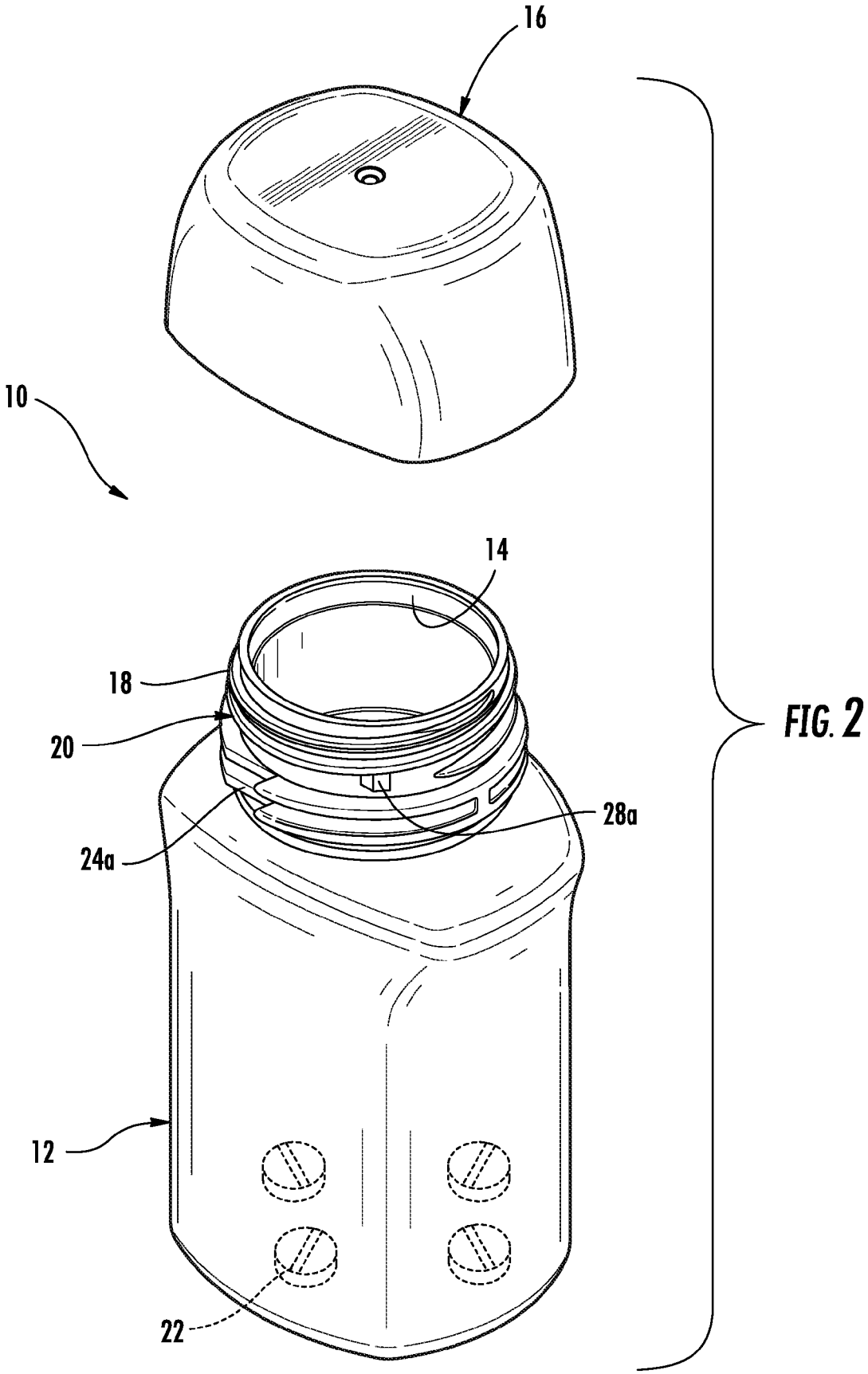
FIG. 2 is an exploded perspective view of the cap and container of FIG. 1.

As seen in the attached drawing figures, details of the preferred embodiment of the device 10 of the present invention are shown. Referring first to FIGS. 1 and 2, a perspective view of the closure and cap device 10 of the present invention is shown. A main container or bottle 12 with a top open mouth end 14 with a cap 16 that twists thereon for connection thereto. As seen specifically in FIG. 2, threads 18 are provided about the neck 20 of the container 12 to threadably receive the cap 16. While these threads 18 are shown as a continuous single thread more than 360 degrees about the neck 20 of the container 12, the threads 18 may be interrupted or partial in configuration, such as to facilitate molding, and less than 360 degrees about the neck of the container. Details of such molding techniques are so well known in the art, they need not be discussed herein.

Also, the threads 18 are preferably located on the neck 20 of the container 12 of the device 10. However, depending on the desired configuration of the device 10, the threads 18 may be located on the container 12 itself or on a neck 20 that has a different configuration. All of the these variations are considered within the scope of the present invention. Thus, as will be described in further detail below, the cap 16 is capable of being rotatably secured to the top of the container 12 to close off the top open end 14 thereof from access.

Further, the cap 16 can also be locked to the top of the container 12 to provide child resistance for added safety to protect the contents therein, such as medication 22.

As can be seen generally in FIG. 2, a pair of lock seats 24*a* and 24*b*, with only one (24*a*) of the pair of locking seats 24*a* and 24*b* being viewable in FIG. 2, are provided to respectively receive locking ribs 26*a* and 26*b*, as best seen in and described in connection with FIGS. 7-11 below. Still further, threading stops 28 are also provided to control the rotationally movement of the cap 16 relative to the container 12 when it is being threaded thereon. Details of such stop action will be discussed below in connection with FIGS. 9 and 10.

Figure 3:
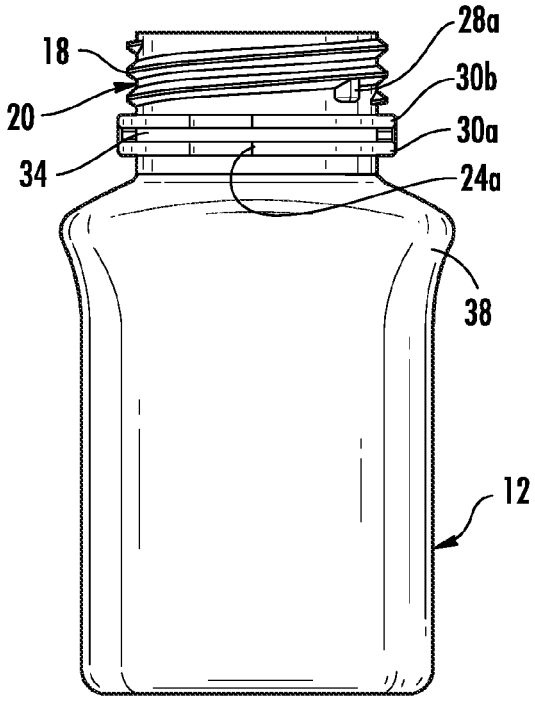
FIG. 3 is a front elevational view of the container shown in FIG. 1.
Figure 4:
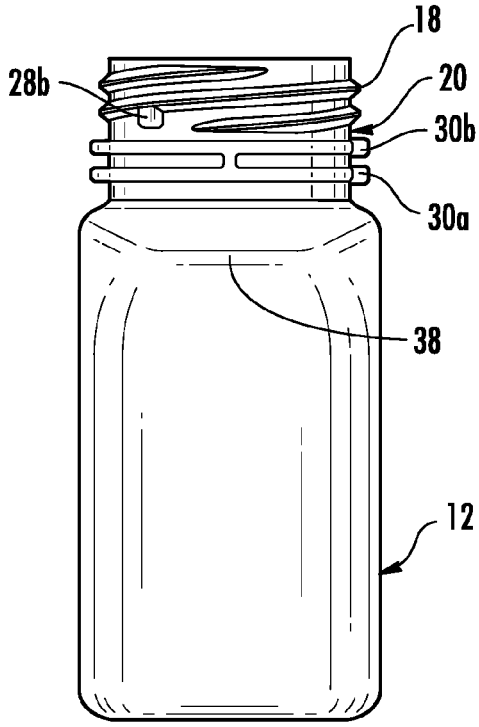
FIG. 4 is a side elevational view of the container shown in FIG. 1.
Figure 5:
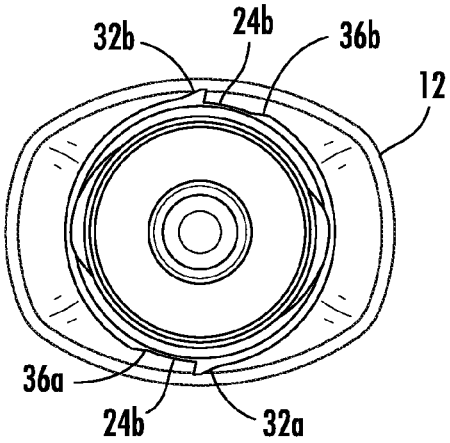
FIG. 5 is a top view of the container shown in FIG. 1.
Figure 6:
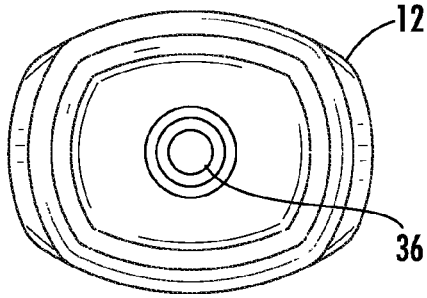
FIG. 6 is a bottom view of the container shown in FIG. 1.

Further details of the device 10 of the present invention is shown in FIGS. 3-6. A front elevational view of the container 12 is shown in FIG. 3 while a side elevational view of the container 12 is shown in FIG. 4. FIG. 5 shows a top view while FIG. 6 shows a bottom view. In FIG. 3, the notch 24*a* is preferably defined by a number of circumferential flanges, such as two referenced by 30*a* and 30*b*, about the neck of the container 12. As seen in FIG. 5, the flanges 30*a* and 30*b*, in cooperation with each other, provide the desired notches 24*a* and 24*b* on opposing sides of the device 10. It is also possible that the notches 24*a* and 24*b* are formed in a unitary member (not shown) rather than the pair of circumferential flanges 30*a* and 30*b*. The trailing edges 32*a* and 32*b* of the flanges 30*a* and 30*b* respectively about the notches 24*a* and 24*b* are preferably ramped to permit clockwise only threading, as best seen in FIG. 5.

The flanges 30*a* and 30*b* also form a collar that can be utilized for automated handling and filling of devices 10 with containers 12 and caps 16 of the present invention. For example, automated bottling equipment, that is known in the art (not shown), can reside in the channel 34 defined by the two flanges 30*a* and 30*b*, as seen in FIG. 5, to facilitate such automated handling. A recess 36 in the bottom of the container 12, as seen in FIG. 6, also can be used to assist in the handling of the container 12 during handling and bottling operations for the device 10.

For rotational control of the cap 16 relative to the container 12, each notch 24*a* and 24*b*, as best seen in FIG. 5, is bordered by a leading edge 36*a* and 36*b* and a trailing edge 32*a* and 32*b* of the flanges 24*a* and 24*b*. As will be as shown and described in connection with FIGS. 7-11, the protrusions 26*a* and 26*b* cam into their respective notches 24*a* and 24*b* as the cap 16 is threaded downwardly onto the neck 20 of the container 12.

FIGS. 3 and 4 show elevational views of the container 12 of the device 10 of the present invention. The flaring shoulders 38 of the container 12 improve the aesthetics of the overall look of the device 10. Although this is a preferred aesthetic configuration for the device 10 of the present invention, the container 12 may be shaped in any way and still include the functional featured described and claimed herein.

Figure 7:
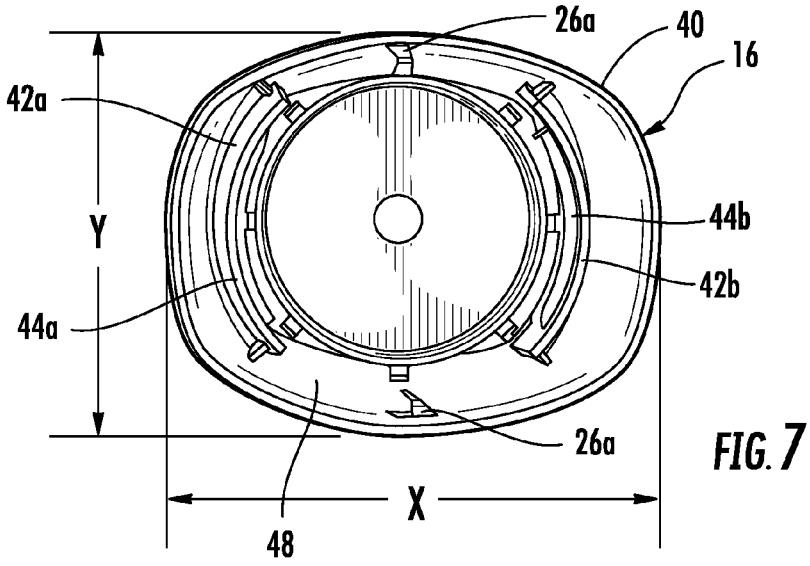
FIG. 7 is a bottom view of the cap shown in FIG. 1.
Figure 8:
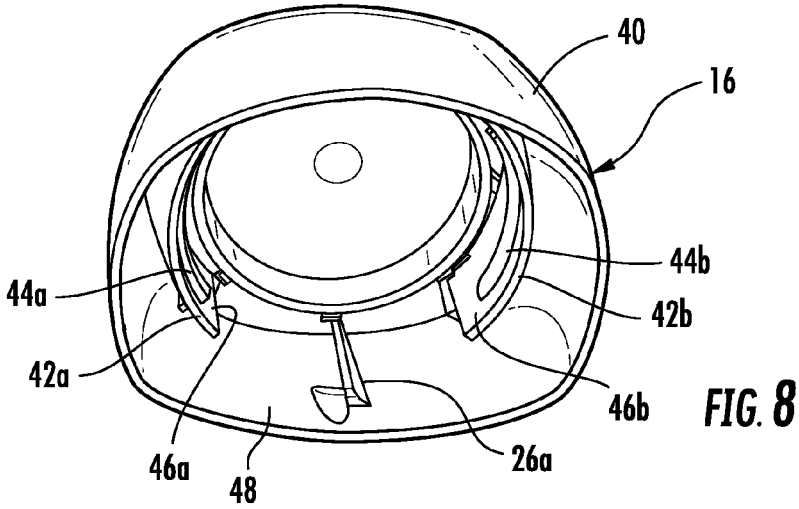
FIG. 8 is a bottom perspective view of the cap shown in FIG. 1.
Figure 9:
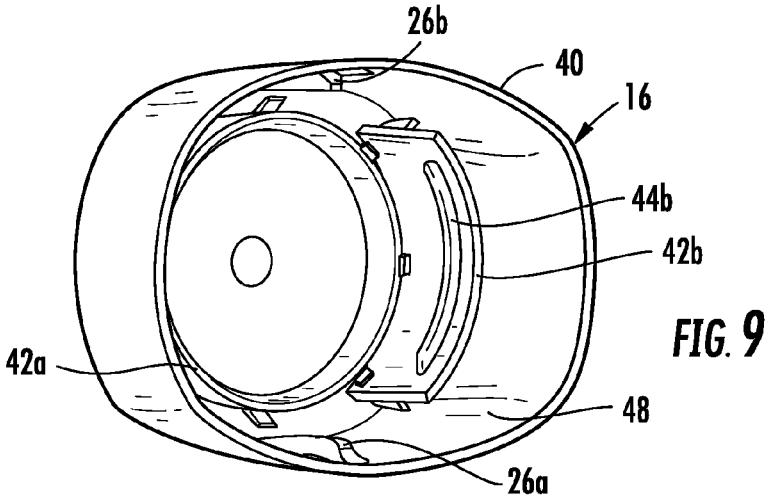
FIG. 9 is a side perspective view of the cap shown in FIG. 1.

Turning now to FIGS. 7-9, construction of the cap portion 16 of the device 10 of the present invention is shown in detail. The cap 16 includes an outer flexible shell 40 and downwardly depending walls 42*a* and 42*b*, preferably arcuate in shape, that carry partial threading 44*a* and 44*b*, or similar securing structures, thereon. The threading 44*a* and 44*b* resides respectively on the inner surfaces 46*a* and 46*b* of the partial or split walls 42*a* and 42*b* where the threads 44*a* and 44*b* on each of the walls 42*a* and 42*b*, in cooperation with each other, simulate the necessary female helical threading of the appropriate pitch to threadably engage or otherwise engage with the male threading 18 about the neck 20 of the bottle, as seen in FIGS. 3 and 4, for example.

Figure 10:
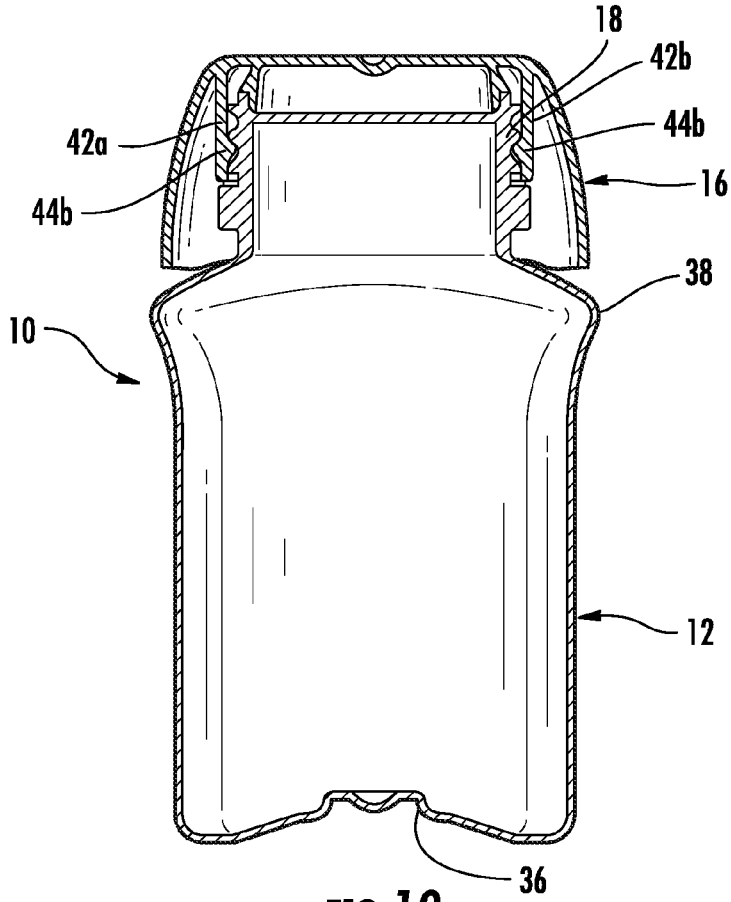
FIG. 10 is a cross-sectional view through the line 10-10 of FIG. 1.

In accordance with the present invention, the female threading 44*a* and 44*b* is not a full 360 degrees about the male threaded neck 20 on the container 12. Sufficient threaded engagement of the cap 16 to the neck 20 can be achieved with only the engagement of the partial threads 4*a* and 44*b* on the split walls 42*a* and 42*b* with the threading 18 on the neck 20 of the container 12. FIG. 10 shows the cap 16 fully threaded on the male threaded neck 20 of the container 12 using only the partial walls 42*a* and 42*b* and threading 44*a* and 44*b* thereon to provide the needed threaded engagement.

Since the split walls 42*a* and 42*b* are present under the outer shell 40 of the cap 16, the transverse dimension "X" of the cap, as shown in FIG. 7, must be large enough to embrace the split walls 42*a* and 42*b*. However, since the split walls 42*a* and 42*b* are not present in certain locations about the periphery of the cap 16, the flexible outer shell 40 of the cap 16 can be reduced substantially in width, such as the dimension shown as "Y", also shown in FIG. 7. Thus, the dimension of the cap 16 in the Y direction can be substantially less than it is in the X direction.

If the walls 42*a* and 42*b* were not of the partial or split construction of the present invention, an inner threaded wall would be a unitary 360 degree wall, as in the prior art. As a result, an outer shell would have to extend out and be large enough to accommodate and embrace the threaded wall in all direction thereby making the overall cap much larger in size. As a result, a prior art cap would have a Y dimension of the same length as in the X dimension making for a much larger and less aesthetically pleasing cap and overall device configuration compared to the device 10 of the present invention.

Therefore, in the device 10 of the present invention, when walls are split into partial threaded walls 42*a* and 42*b*, the space that is normally taken up with a threaded 360 degree wall can now be occupied by a portion of the flexible outer shell 40 of the cap 16. As a result, the overall dimension of the cap 16 is significantly reduced in one transverse direction to reduce the overall size of the cap 16 while still accommodating the same size bottle container opening 14. For example, to accommodate a 1.25 inch diameter opening 14, the cap 16 may have a width of, for example, about 41.99 mm across and a length of, for example, about 49.51 mm. In contrast, a prior art cap 16 must be large enough in all directions to accommodate the same opening 14. Therefore, a prior art cap would, in this example, have a length or diameter if the cap is round, of at least about 50 mm in all directions thereby making it an overall larger cap than applicant's inventive closure device 10.

Figure 11:
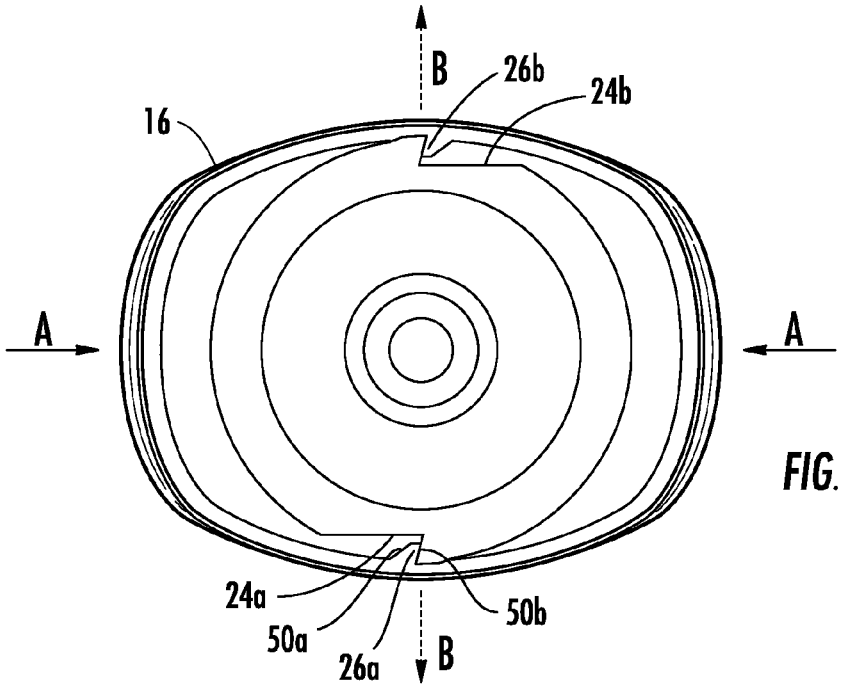
FIG. 11 is a cross-sectional view through the line 11-11 of FIG. 1 with the cap at rest.

The device 10 of the present invention also provides child resistance to the interconnection of the cap 16 to the container 12. The preferred child resistance configuration is shown in FIGS. 7-9 and 11. Vertical ribs or locking lugs 26*a* and 26*b* are protrusions provided on the inner surface 48 of the flexible outer shell 40 of the cap 16 that releasably engage with respective notches or lock seats 24*a* and 24*b* on a locking collar formed by flanges 30*a* and 30*b* on the neck 20 of the container. FIGS. 2 and 5 show such notches 24*a* and 24*b* while FIG. 11 shows the interconnection of the locking ribs 26*a* and 26*b* respectively with the lock seats 24*a* and 24*b*.

In operation, when the cap 16 is screwed on in a clockwise direction, with the threads 44*a* and 44*b* on the partial walls in threaded engagement with the threads 18 on the neck 20 of the container 12, the ribs 26*a* and 26*b* ride or cam over the locking collar flanges 30*a* and 30*b* while slightly flexing the outer shell 40 of the cap 16 outwardly. When the protrusions 26*a* and 26*b* are located over their respective lock seat 24*a* and 24*b*, the protrusions 26*a* and 26*b* are urged downwardly by the inward spring-biasing of the flexible outer shell 40 of the cap 16. As a result, the protrusions 26*a* and 26*b* seat into their respective lock seats 24*a* and 24*b*. Since the leading edges 50*b* of the protrusions 26*a* and 26*b* and trailing edge 32*b* of flanges 30*a* and 30*b* next to the notches 24*a* and 24*b* are complementarily ramped, the cap 16 may only be threaded in a clockwise direction toward further screwing the cap 16 onto the container 12. In the preferred embodiment, two locking protrusions 26*a* and 26*b* and two notches 24*a* and 24*b* respectively engage either although less or more than two sets of locking may be provided.

When the cap 16 is rotated in a direction to be removed, such as in a counterclockwise direction, it cannot be threadably removed (unscrewed) because the trailing edge 50*b* of the protrusions 26*a* and 26*b* are engaging with the trailing edges 32*b* of the flanges 30*a* and 30*b* to the rear of the notches 24*a* and 24*b*, as seen in FIG. 11. The protrusions 26*a* and 26*b* must be lifted out of their respective notches 24*a* and 24*b* to permit unscrewing of the cap 16 from the threaded neck 20 of the container 12.

Figure 12:
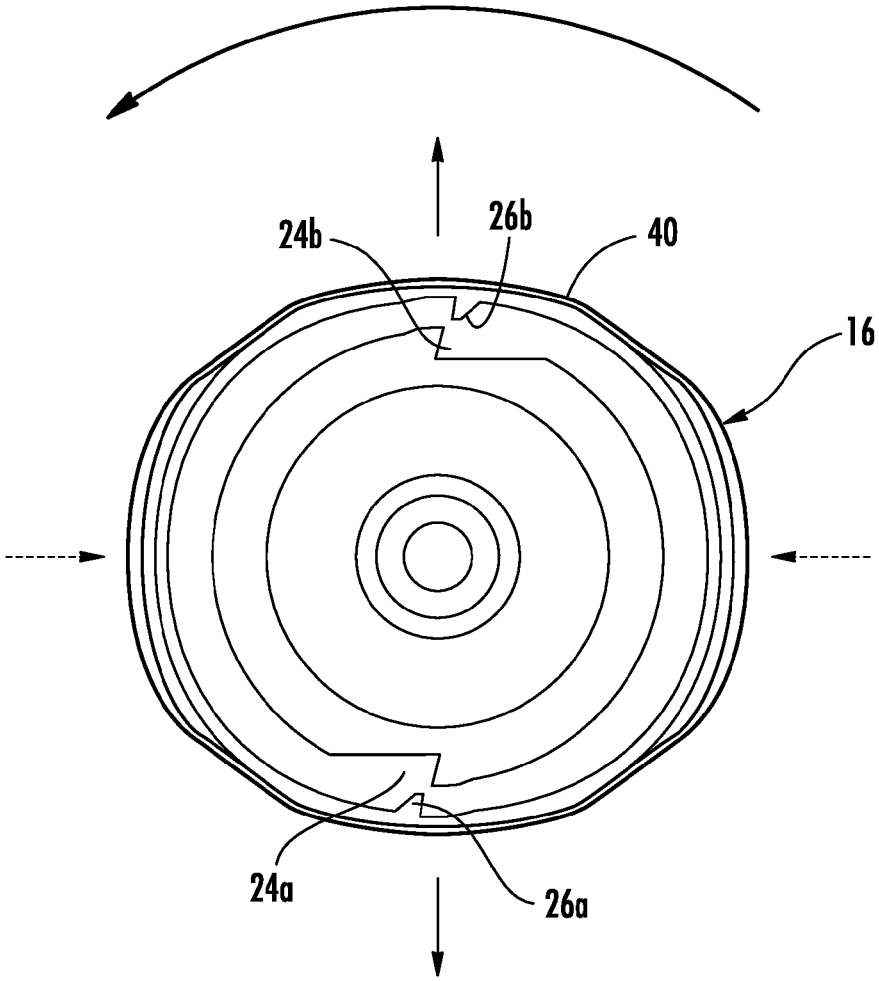
FIG. 12 is a cross-section view through the line 11-11 of FIG. 1 with the cap squeezed for unthreading thereof.

For removal, as seen in FIG. 11, opposed sides of the cap 16 are squeezed, namely, pressed in the direction of arrows "A", to thereby lift the protrusions 26*a* and 26*b* out of their respective notches 24*a* and 24*b* in the direction indicated by the arrows "B". Once the protrusions 26*a* and 26*b* clear from their notches 24*a* and 24*b*, as seen in FIG. 12, the cap 16 can be freely unscrewed in a counterclockwise direction from the neck 20 of the container 20 and then separated from the container 12 to gain access to the contents 22 therein.

The present invention can be carried out in many different ways employing the unique split downwardly depending securing walls 42*a* and 42*b* of the present invention. For example, the threads 44*a* and 44*b* on the split inner walls 42*a* and 42*b* for retention of the cap 16 and the locking protrusions 26*a* and 25*b* can be modified if desired and still be within the scope of the present invention. For example, the threads 44*a* and 44*b* can be any type of construction that complementarily secures the split walls 42*a* and 42*b* to the neck 20 of the container 12.

In view of the foregoing, the present invention provides a device 10 with a container 12 and cap 16 construction that reduces the size of the cap 16 because the interior threaded walls 42*a* and 42*b* are only partial/split to allow the outer flexible shell 40 of the cap 16 to reside in the voids between the partial walls 42*a* and 42*b*. Thus, a large bottle mouth 14 can be accommodated with a smaller profile cap 16 by not requiring a full circular threaded inner skirt securing member as found in the prior art.

The present invention may be formed of any type of material that is suitable for the application at hand. For example, injection molded plastic is preferred for its ease of manufacture, cost and durability.

It would be appreciated by those skilled in the art that various changes and modifications can be made to the illustrated embodiments without departing from the spirit of the present invention. All such modifications and changes are intended to be covered by the appended claims.

What is claimed is:

1. A closure construction, comprising:

a container having a bottom closed end with a neck defining a top open end;

male threading disposed on the neck and about the top open end;

a pair of locking notches residing in the neck on opposing sides of the top open end;

a cap removably connected to the neck of the container; the cap including an outer shell with top wall, an outer wall, having an inner surface, and an open bottom end;

a pair of arcuate walls, each having a concave surface and connected to and downwardly depending from the top wall of the cap in spaced apart relation from each other defining a gap therebetween; partial threading disposed on each of the concave surfaces of the arcuate walls to, in cooperation with each other, provide a threaded connection between the cap and the male threading disposed on the neck of the container thereby releasably securing the cap to the container;

a pair of protrusions connected to and emanating inwardly from the inner surface of the outer wall; the pair of protrusions residing along a line running through the gap between the pair of arcuate walls and being releasably respectively seated in the pair of locking notches when the cap is threaded past a predetermined point onto the neck of the container to threadably lock the cap to the container.

2. The closure construction of claim 1, wherein the outer shell of the cap is flexible and compressible in a substantially perpendicular direction to the line running through the gap between the pair of arcuate walls; whereby inward compression of the outer shell of the cap in a direction along the substantially perpendicular direction unseats the pair of protrusions from the pair of locking notches thereby permitting the cap to be unthreaded from the neck of the container.

3. The closure construction of claim 1, wherein the partial threading disposed on each of the concave surfaces of the arcuate walls is less than 360 degrees.

4. The closure construction of claim 1, wherein the outer shell of the cap has a width and a length, the width, as measured along the line running through the gap between the pair of arcuate walls, that is less than the length, as measured through a line substantially perpendicular to the line running through the gap between the pair of arcuate walls.

5. The closure construction of claim 1, wherein the pair of locking notches each includes a substantially vertical side and an angled side.

6. The closure construction of claim 1, wherein the pair of protrusions cam into respective locking engagement with the pair of locking notches.

7. The closure construction of claim 1, further comprising:

a stop member located on the container and engagable with the threading on at least one of the pair of arcuate walls.

* * * * *